US009420902B2

(12) United States Patent
Taylor

(10) Patent No.: US 9,420,902 B2
(45) Date of Patent: Aug. 23, 2016

(54) SHELF WEDGE FOR DISPLAYING PRODUCTS ON AN EXISTING SHELF SYSTEM

(71) Applicant: NESTEC SA, Vevey (CH)

(72) Inventor: Curtis Taylor, Chagrin Falls, OH (US)

(73) Assignee: Nestec S.A., Vevey (CH)

( * ) Notice: Subject to any disclaimer, the term of this patent is extended or adjusted under 35 U.S.C. 154(b) by 5 days.

(21) Appl. No.: 14/624,707

(22) Filed: Feb. 18, 2015

(65) Prior Publication Data

US 2015/0230630 A1 Aug. 20, 2015

Related U.S. Application Data

(60) Provisional application No. 61/941,659, filed on Feb. 19, 2014.

(51) Int. Cl.
*A47F 5/10* (2006.01)
*A47F 5/16* (2006.01)

(52) U.S. Cl.
CPC ... *A47F 5/10* (2013.01); *A47F 5/16* (2013.01); *A47F 2005/165* (2013.01); *Y10T 29/49826* (2015.01)

(58) Field of Classification Search
CPC ..... A47F 5/10; A47F 5/16; A47F 2005/165
USPC ..... 211/126.15, 126.6, 132.1, 153
See application file for complete search history.

(56) References Cited

U.S. PATENT DOCUMENTS 253,981 A * 2/1882 Conrad ..... A47B 31/00 211/126.15
1,750,575 A * 3/1930 Cubberley ..... A47B 65/00 211/11
2,631,042 A * 3/1953 Bertram ..... A63F 1/10 206/449
3,428,381 A * 2/1969 Appel ..... B65D 1/34 206/514
3,612,288 A * 10/1971 Lesley ..... A47F 7/281 108/2
3,685,687 A * 8/1972 Eckdahl ..... A47G 23/06 206/504
3,939,987 A * 2/1976 Bustos ..... A47F 7/28 211/134
4,384,651 A * 5/1983 Smith ..... A47F 5/114 211/132.1
4,537,316 A * 8/1985 Simon ..... A47F 5/0025 211/133.3
4,705,175 A * 11/1987 Howard ..... A47F 5/103 108/109
4,978,013 A * 12/1990 Hogg ..... A47F 5/13 211/132.1
D323,354 S * 1/1992 Nava ..... D19/78
5,259,578 A * 11/1993 Jones ..... A47C 5/005 211/24
5,265,740 A * 11/1993 Hodsden ..... A47B 57/08 211/187
5,630,518 A * 5/1997 Collins ..... A47F 5/112 211/132.1
5,868,367 A * 2/1999 Smith ..... A47F 5/112 211/73
6,659,293 B1 * 12/2003 Smith ..... A47F 1/12 211/126.15
8,424,693 B1 * 4/2013 Hoover ..... A47F 5/0062 211/126.15
2012/0228174 A1 * 9/2012 Wegener ..... B65D 19/44 206/427
2013/0075349 A1 * 3/2013 MacDonald et al. ... B42F 7/145 211/11

FOREIGN PATENT DOCUMENTS

WO WO 2005/035394 * 4/2005 ..... B65D 19/16
WO WO 2008/120512 * 10/2008 ..... B65D 19/44

* cited by examiner

*Primary Examiner* — Michael Safavi
(74) *Attorney, Agent, or Firm* — Ronald A. Burchett; Julie M. Lappin

(57) ABSTRACT

A shelf wedge can be used to display products. The shelf wedge can have an adjustable length which can be selectively established by moving a base section relative to a back section, for example by sliding the base section on projections extending from the body of the back section. A method of displaying products is also provided.

16 Claims, 9 Drawing Sheets

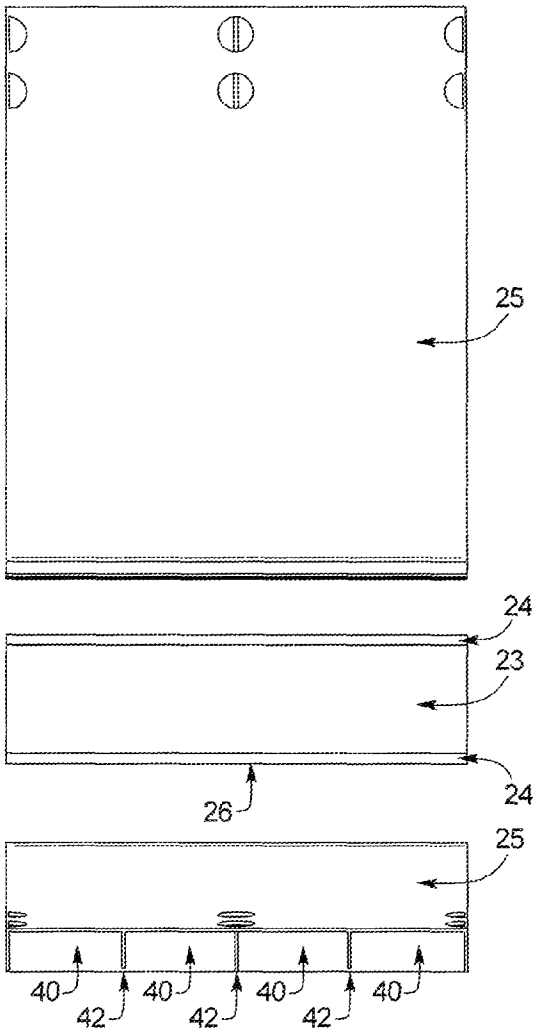
FIG. 2C
FIG. 2D
FIG. 2E
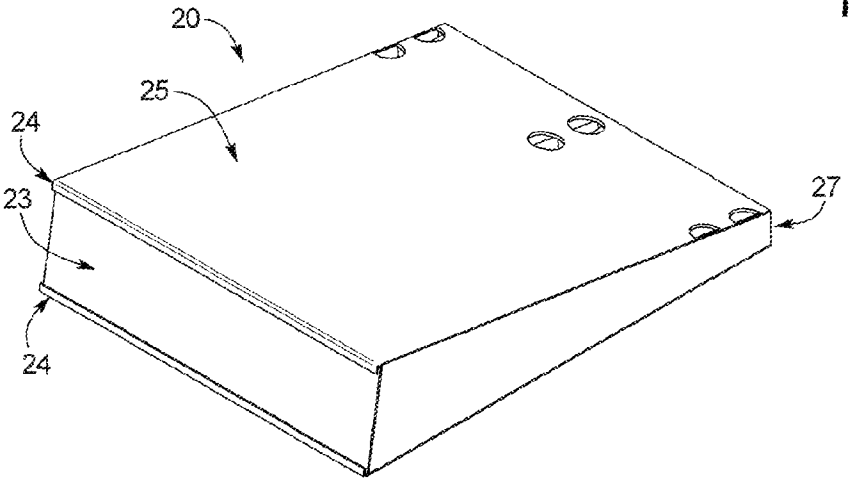
FIG. 2A
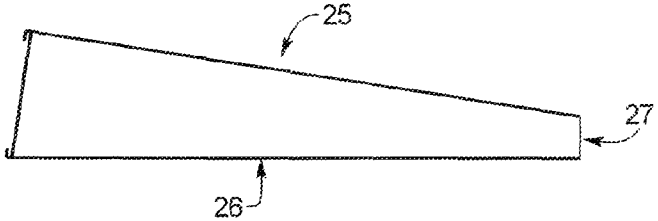
FIG. 2B

SHELF WEDGE FOR DISPLAYING PRODUCTS ON AN EXISTING SHELF SYSTEM

PRIORITY CLAIM

The present application claims priority to U.S. Provisional Application No. 61/941,659, filed on Feb. 19, 2014, the entire contents of which are incorporated herein by reference.

BACKGROUND

A store selling products generally stores and displays the products on a shelf or hanging from a rack. However, such arrangements typically do not satisfactorily show the features of the products. Some products have specific devices configured for the particular features of the product and that facilitate display of the product. However, such devices are not compatible with all display shelves and may not be usable with certain shelves or may provide an awkward display with some shelves, for example hanging off the front of the shelf, pushed back from the front of the shelf, or otherwise having a size that is not aligned with the size of the shelf.

SUMMARY

The present invention relates to a shelf system, and more particularly to a shelf or shelf insert, and still more particularly to a shelf or shelf insert that can be used in an existing shelf system.

Accordingly, in a general embodiment, the present disclosure provides an apparatus for displaying products. The apparatus comprises: a base section comprising a first end and a second end that are opposite ends of the base section from each other, the first end defining a front face and having a height greater than the second end; and a back section comprising a body movably connected to the second end of the base section, and the base section is configured to slide on a portion of the back section toward and away from the body of the base section.

In an embodiment, the back section comprises a first projection that extends from the body of the back section, and the base section is configured to slide on the first projection.

In an embodiment, the second end of the base section comprises a first channel, and at least a portion of the first projection has a size and a shape complementary to at least a portion of the first channel.

In an embodiment, the base section comprises an inner wall that forms a side of the first channel, the back section comprises a second projection, and the inner wall of the base section inserts between the first and second projections.

In an embodiment, the base section comprises first and second side walls, and the first side wall forms a side of the first channel opposite to the side of the first channel formed by the inner wall.

In an embodiment, the base section comprises a top surface that extends from the first end to the second end, the top surface is flat, and the inner wall and the first and second side walls extend downward from the top surface.

In an embodiment, the base section comprises a bottom surface from which the inner wall and the first and second side walls extend upward to the top surface, and the bottom surface is flat.

In an embodiment, the front face and the bottom surface form an angle that is less than ninety degrees.

In an embodiment, the first end of the base section comprises a clip arrangement configured to hold printed material on the front face.

In another embodiment, the present disclosure provides a method of displaying a product on a shelf. The method comprises: positioning an apparatus on the shelf, the apparatus having a length and comprising a base section comprising a first end and a second end that are opposite ends of the base section from each other, the first end defining a front face and having a height greater than the second end, the apparatus further comprising a back section comprising a body movably connected to the second end of the base section; adjusting the length of the apparatus by moving the base section toward or away from the body of the back section; and positioning the product on a top surface of the base section.

In an embodiment, the adjusting the length of the apparatus comprises positioning the front face of the base section in vertical alignment with a front edge of the shelf.

In an embodiment, the adjusting the length of the apparatus comprises positioning a rear face of the back section in vertical alignment with a back edge of the shelf.

In an embodiment, the adjusting the length of the apparatus comprises sliding the base section on a portion of the back section.

In an embodiment, the length of the apparatus is the distance from the front face of the base section to a rear face of the back section.

In an embodiment, the method comprises attaching printed material to the front face using a clip arrangement connected to the first end of the base section.

In an embodiment, the method comprises removing an additional shelf from a position above the shelf before positioning the apparatus on the shelf.

In another embodiment, the present disclosure provides a system for displaying merchandise. The system comprises: a base section comprising a first end and a second end that are opposite ends of the base section from each other, the first end defining a front face and having a height greater than the second end, the base section comprising a top surface that extends from the first end to the second end; a back section comprising a body movably connected to the second end of the base section, and the base section is configured to slide on a portion of the back section toward and away from the body of the base section; and a product removably positioned on the top surface of the base section.

In an embodiment, the top surface of the base section comprises a cavity having a size and a shape that are complementary to at least a portion of the product.

In an embodiment, the product is one of a plurality of products that are positioned on the top surface.

In an embodiment, the base section and the back section form an apparatus having a length that is the distance from the front face of the base section to a rear face of the back section, and the apparatus is configured such that sliding the base section toward and away from the body of the base section decreases and increases the length of the apparatus, respectively.

BRIEF DESCRIPTION OF THE DRAWINGS

FIG. 2A is a front perspective view of an embodiment of a base section of a shelf wedge provided by the present disclosure.

FIG. 2B is a side plan view of the embodiment of the base section shown in FIG. 2A.

FIG. 2C is an above plan view of the embodiment of the base section shown in FIGS. 2A and 2B.

FIG. 2D is a front plan view of the embodiment of the base section shown in FIGS. 2A-2C.

FIG. 2E is a back plan view of the embodiment of the base section shown in FIGS. 2A-2D.

DETAILED DESCRIPTION

Figure 1A:
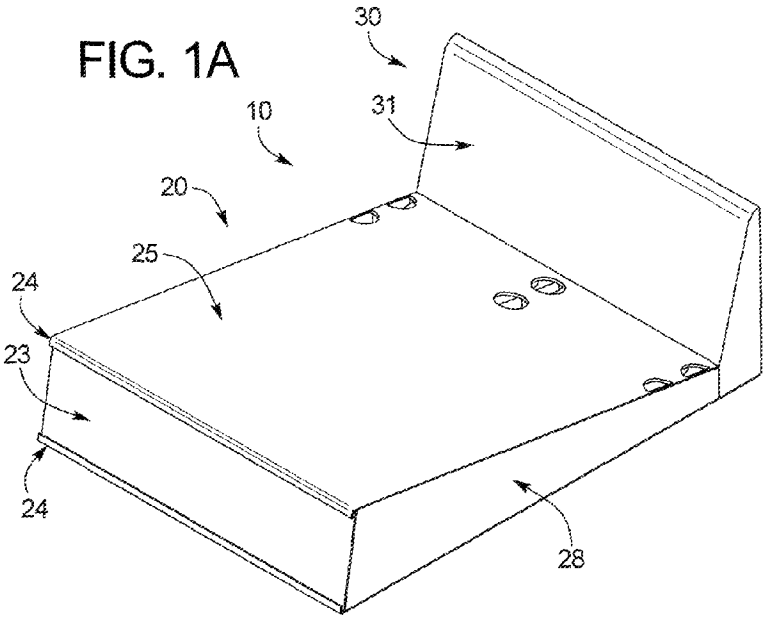
FIG. 1A is a front perspective view of an embodiment of a shelf wedge provided by the present disclosure.
Figure 1B:
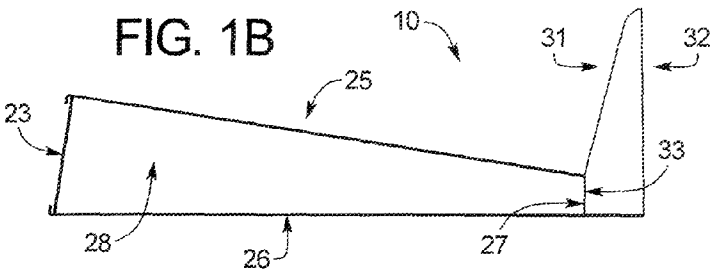
FIG. 1B is a side plan view of the embodiment of the shelf wedge shown in FIG. 1A.
Figure 1C:
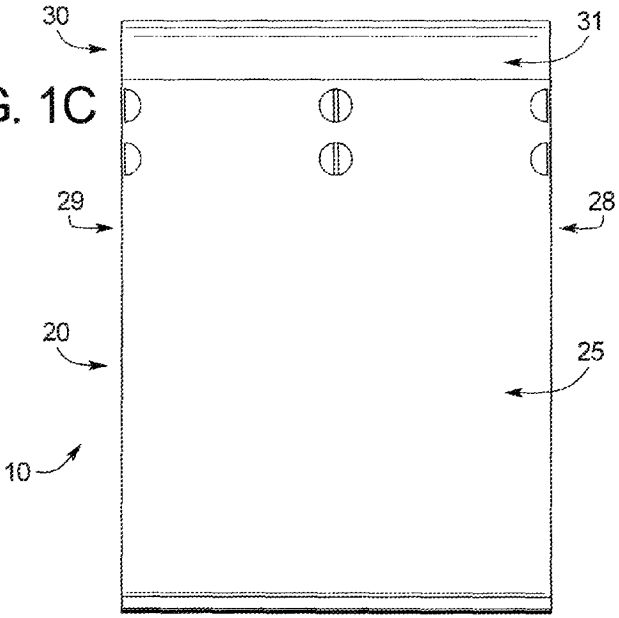
FIG. 1C is an above plan view of the embodiment of the shelf wedge shown in FIGS. 1A and 1B.
Figure 1D:
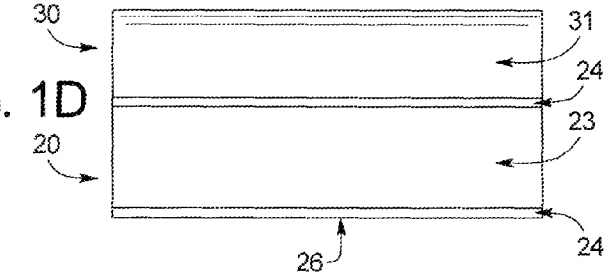
FIG. 1D is a front plan view of the embodiment of the shelf wedge shown in FIGS. 1A-1C.
Figure 3A:
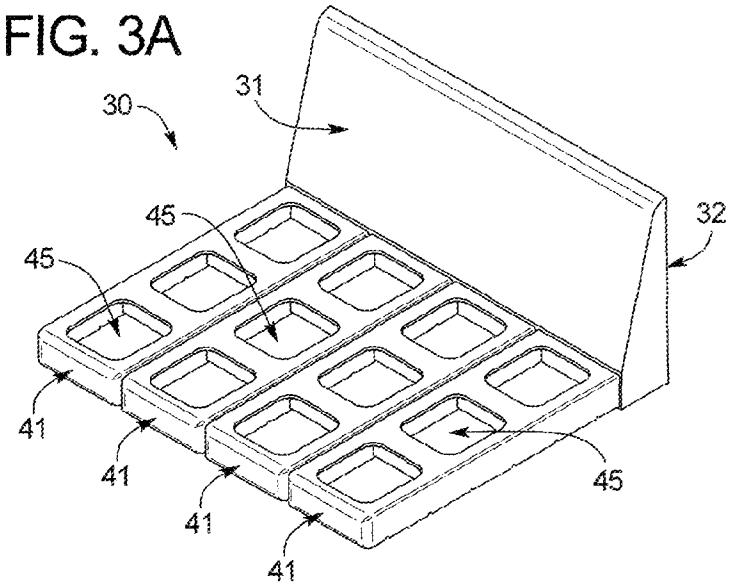
FIG. 3A is a front perspective view of an embodiment of a back section of a shelf wedge provided by the present disclosure.
Figure 3B:
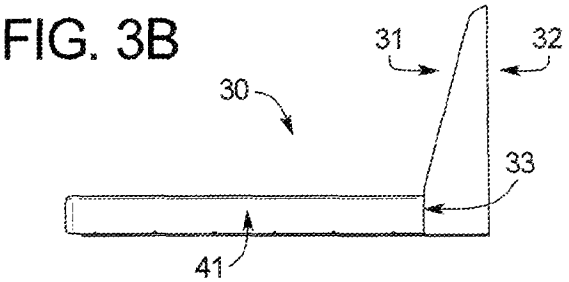
FIG. 3B is a side plan view of the embodiment of the back section shown in FIG. 3A.
Figure 3C:
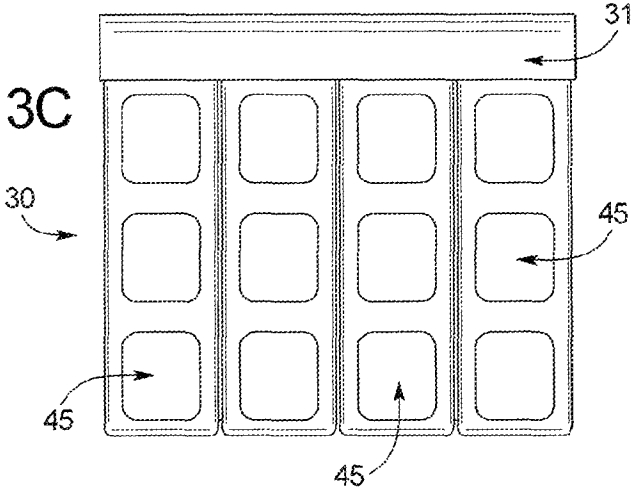
FIG. 3C is an above plan view of the embodiment of the back section shown in FIGS. 3A and 3B.
Figure 3D:
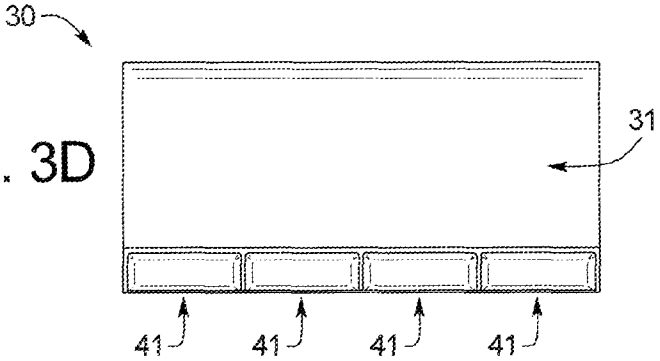
FIG. 3D is a front plan view of the embodiment of the back section shown in FIGS. 3A-3C.

FIGS. 1A-1D, 2A-E and 3A-D illustrate a non-limiting embodiment of a shelf wedge 10 of the present invention. FIGS. 4-8 illustrate a non-limiting application as to how to use the shelf wedge 10 of the present invention.

Referring again to FIGS. 1 and 2, a shelf wedge 10 is illustrated as a multi-piece system; however, the shelf wedge 10 can be formed of a single component. The size, shape and material of the shelf wedge 10 are non-limiting. The shelf wedge 10 is illustrated as including a base section 20 and a back section 30. The base section 20 is illustrated as being a wedge-shaped section with side walls 28,29 having a continuously decreasing height as they extend from the front face 23 to the thinner end 27 of the base section 20. The top surface 25 of the base section 20 is illustrated as being generally flat; however, this is not required. The thinner end 27 of the base section 20 is designed to be connected to the back section 30. The back section 30 can be designed to be permanently or releasably connected to the base section 20.

The front face of the body of the back section 30 can comprise an upper front face 31 and a lower front face 33. The upper front face 31 can slope downward such that the thickness of the back section 30 (i.e., the distance from the upper front face 31 to the rear face 32) increases as the distance from the top of the back section 30 increases.

The back section 30 can comprise one or more projections 41 that can extend from the body of the back section 30, and each of the one or more projections 41 can have a shape and size that are complementary to one or more channels 40 in the base section 20. Although the figures show four of the projections 41 and four of the channels 40, any number of the projections 41 and any number of the channels 40 can be used in the shelf wedge 10, although a preferred embodiment has a number of the projections 41 that is equal to the number of the channels 40. As shown in the figures, the one or more projections 41 and the one or more channels 40 can be rectangular, but the shelf wedge 10 is not limited to a specific shape of these components.

The channels 40 can be formed by inner walls 42 of the base section 20. For example, the inner walls 42 can extend between the top surface 25 and the bottom surface 26 of the base section 20. The gaps between the inner walls 42 can form the channels 40. One or more of the channels 40 can be partially formed by one of the side walls 28,29.

The front face 23 of the thick end of the base section 20 can optionally include a clip arrangement 24 that can be used to hold a label, advertising literature, etc. As illustrated in FIG. 2, the front face 23 of the base section 20 can be sloped for improved viewing of the material inserted in the clip arrangement 24; however this is not required.

Referring to FIG. 3, the projections 41 of the back section 30 are illustrated as having a generally uniform thickness; however, this is not required. The projections 41 and/or the top surface 25 of the base section 20 can include a plurality of cavities 45 that are designed to each receive a product to be inserted therein. The size, depth and shape of the cavities 45 are non-limiting. As mentioned above, the base section 20 can be permanently or releasably connected to the back section 30. The back section 30 is illustrated as having a wedge-shaped configuration.

Figure 4:
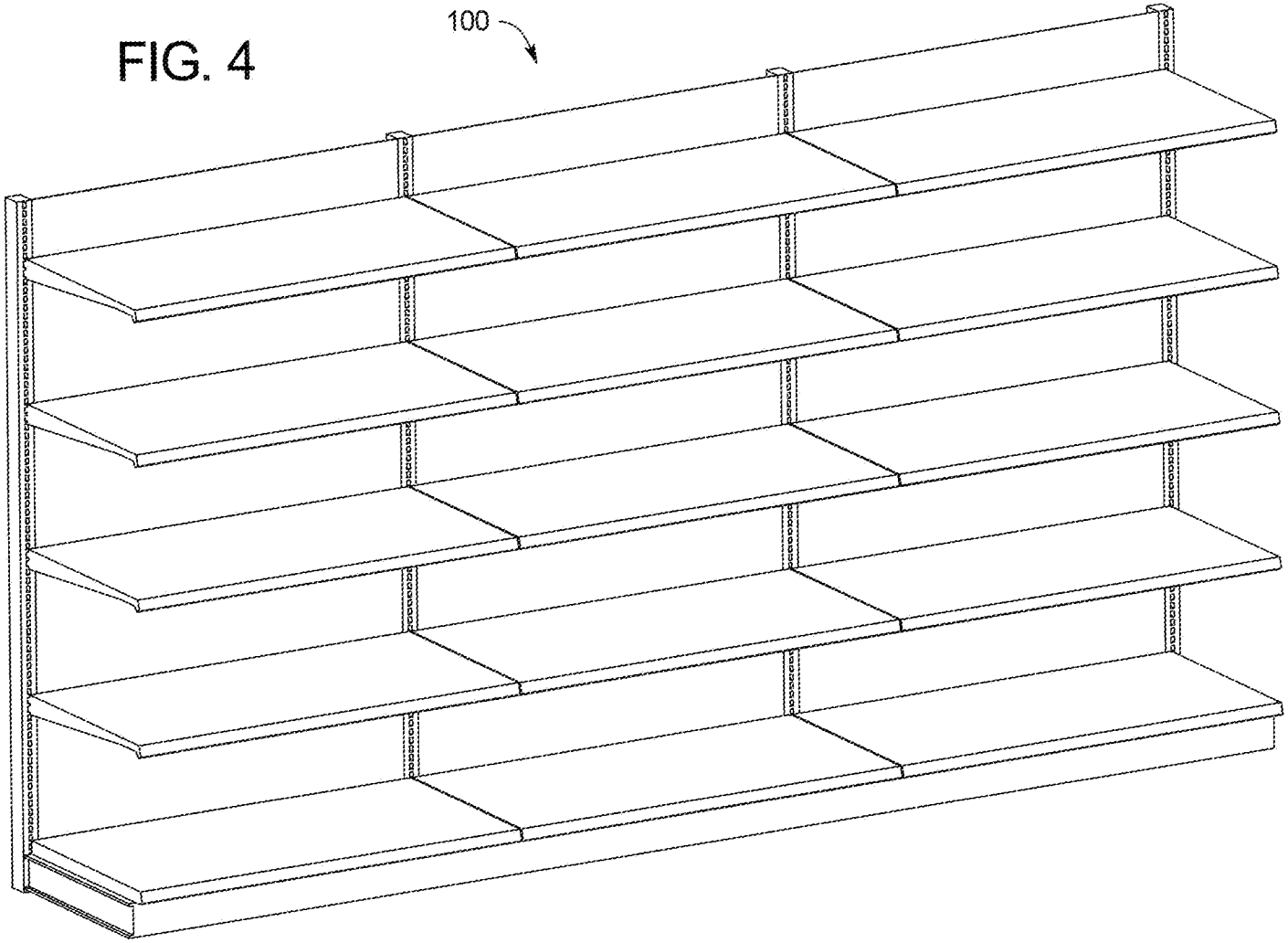
FIG. 4 is a front perspective view of an exemplary shelving area in which a shelf wedge provided by the present disclosure can be used.
Figure 5:
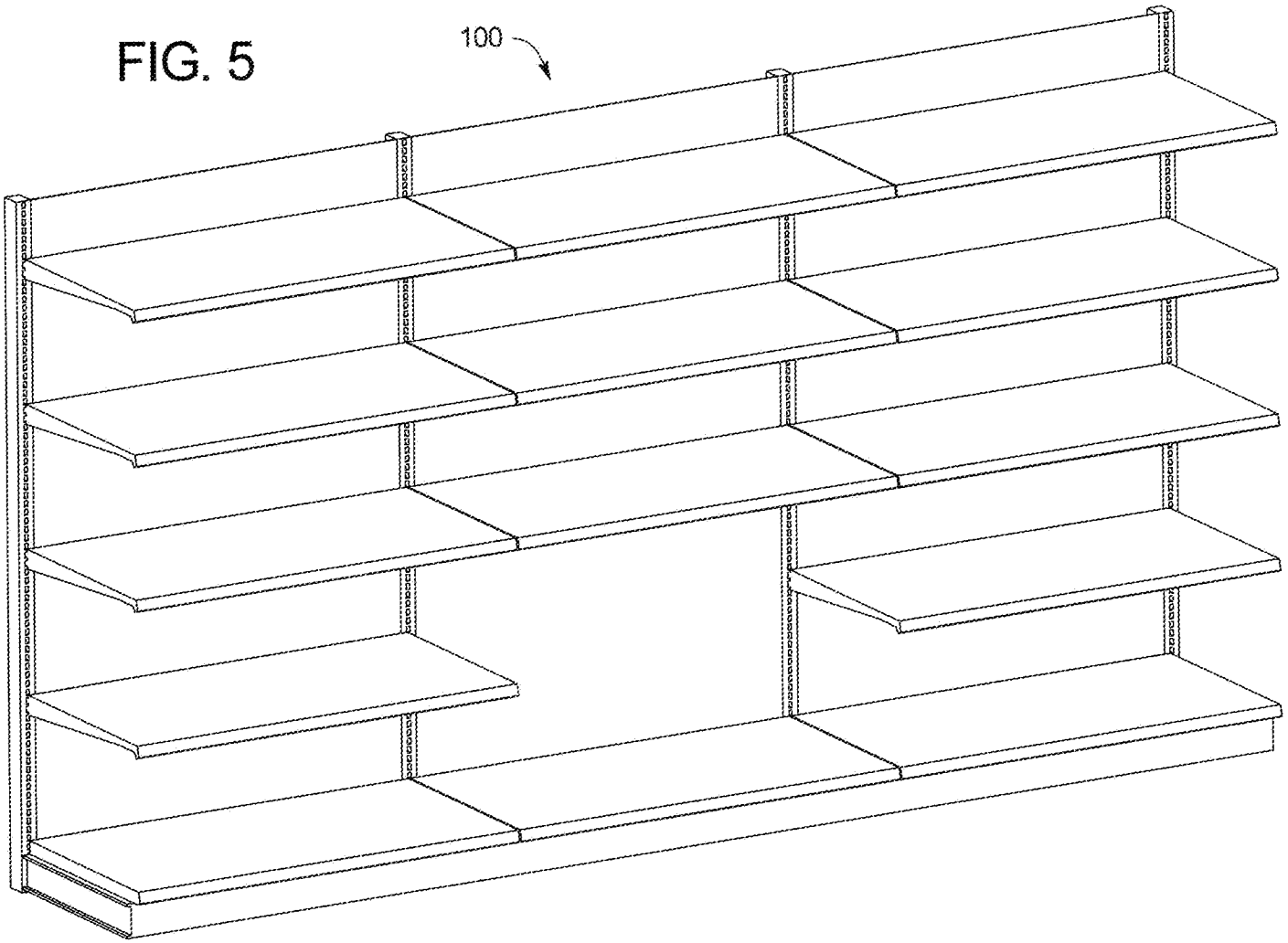
FIG. 5 is a front perspective view of the exemplary shelving area shown in FIG. 4, with a shelf removed therefrom to accommodate the shelf wedge.
Figure 6:
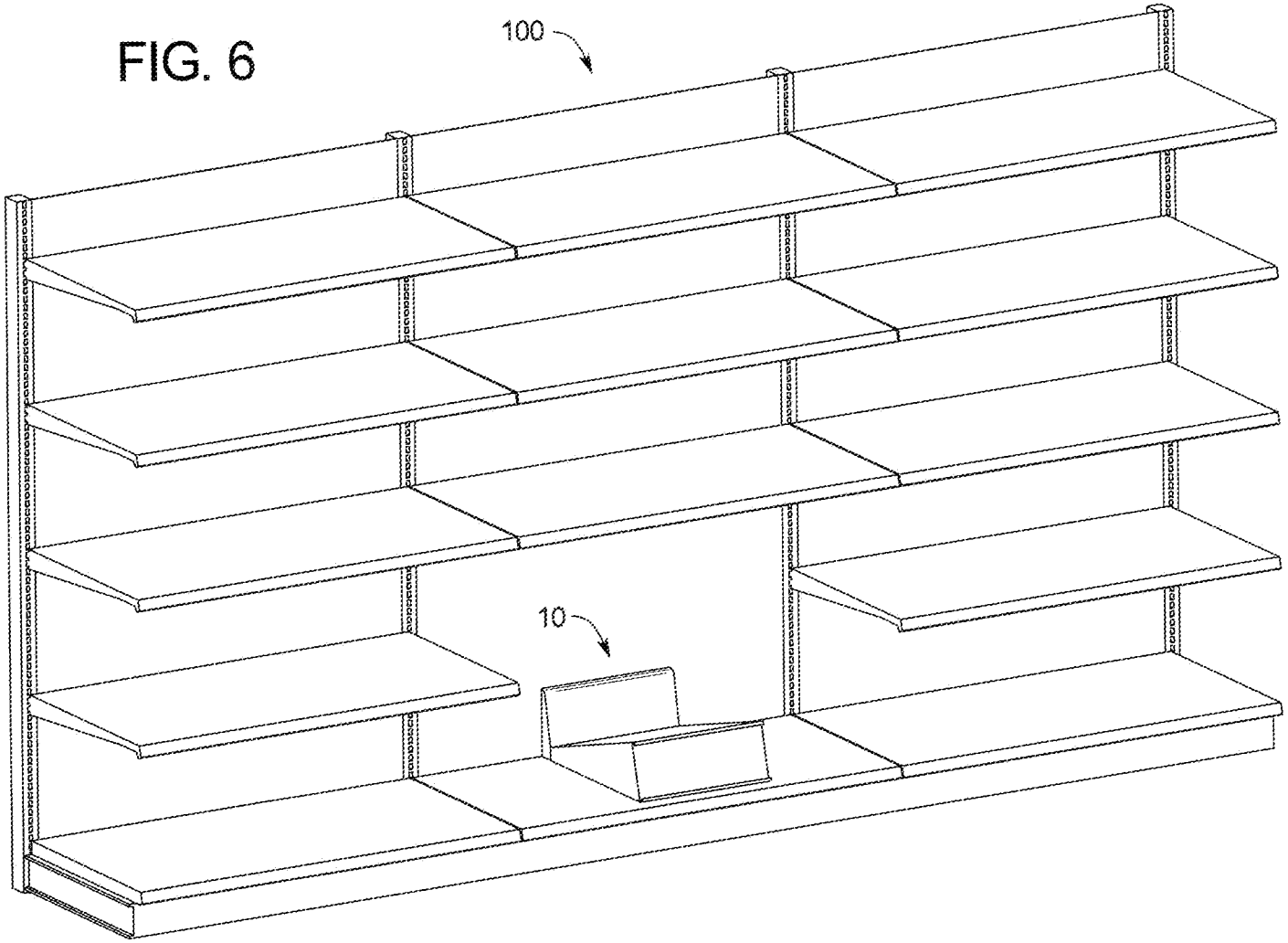
FIG. 6 is a front perspective view of an embodiment of a shelf wedge provided by the present disclosure positioned in the exemplary shelving area shown in FIG. 5.
Figure 7:
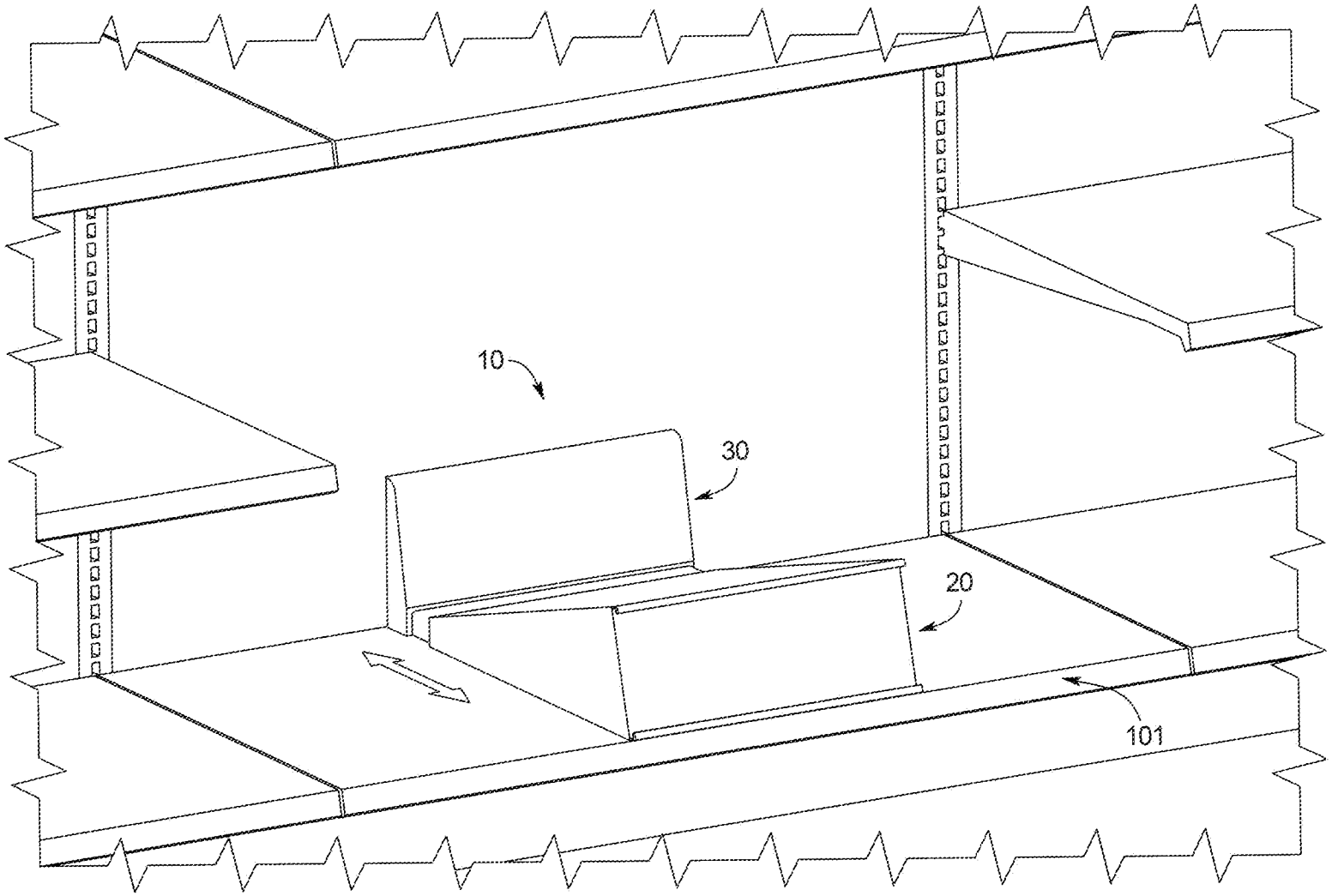
FIG. 7 is a front perspective view of an embodiment of a shelf wedge provided by the present disclosure positioned in the exemplary shelving area shown in FIG. 6, with the shelf wedge adjusted to have a length corresponding to the length of the shelf.
Figure 8:
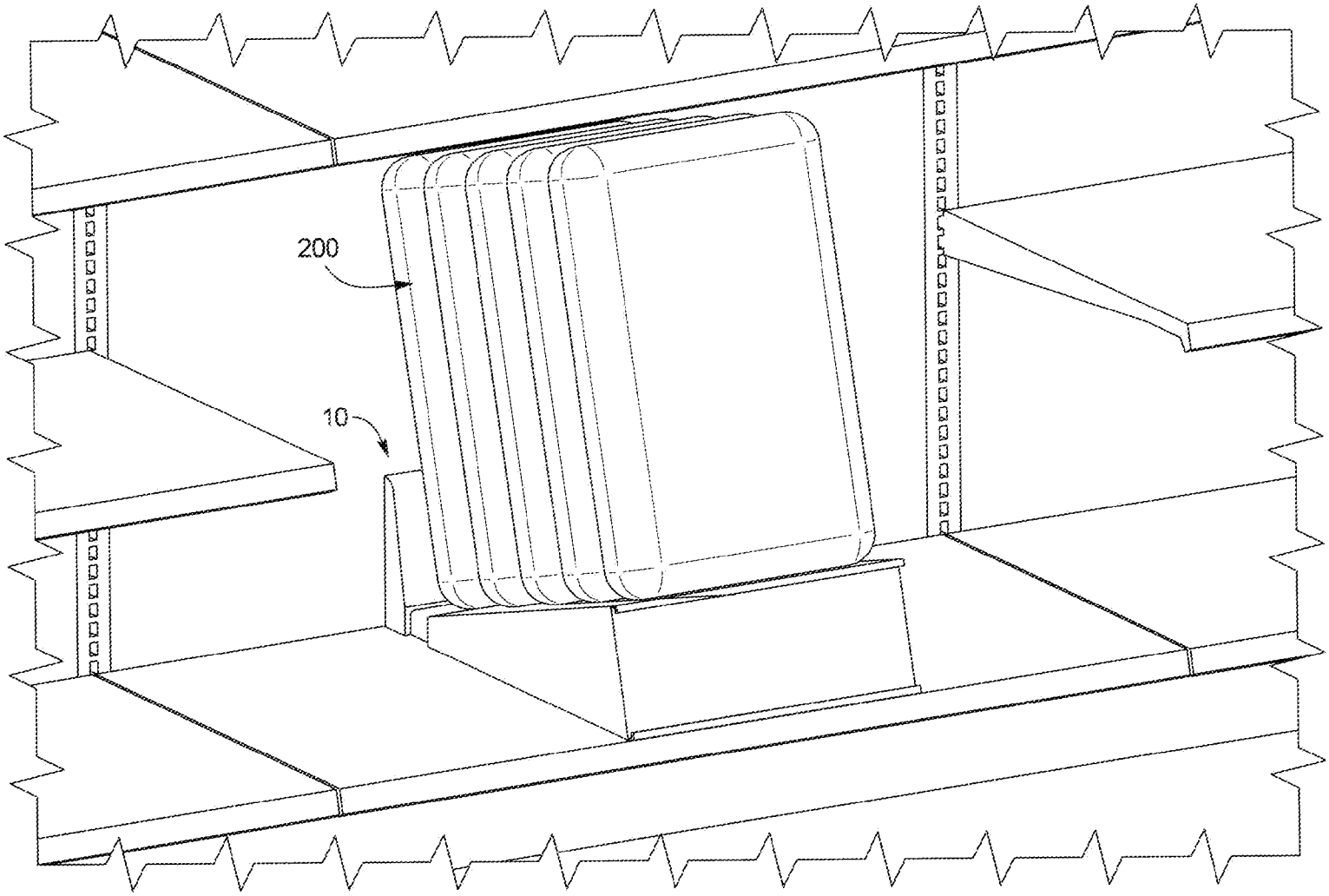
FIG. 8 is a front perspective view of an embodiment of a shelf wedge provided by the present disclosure positioned in the exemplary shelving area shown in FIG. 7, with products positioned on the shelf wedge.

Referring now to FIGS. 4-8, an application of the shelf wedge 10 is disclosed. As shown in FIG. 4, a shelving area 100 can be configured for the display of one or more products. As shown in FIG. 5, one or more shelves can optionally be removed from the shelving area 100 to accommodate the shelf wedge 10, for example to provide clearance for the shelf wedge 10 (e.g., thirty inches of clearance above the shelf on which the shelf wedge is positioned). As shown in FIG. 6, the shelf wedge 10 can be positioned on a shelf of the shelving area 100. As shown in FIG. 7, the base section 20 of the shelf wedge 10 can be moved relative to the back section 30, preferably by sliding the base section 20 on the projections 41 of the back section 30, to decrease or increase the length of the shelf wedge 10. In an embodiment, the base section 20 of the shelf wedge 10 can maintain connection to the back section 30 through lengths of the shelf wedge 10 from twenty-two inches to thirty inches. The front face 23 of the shelf wedge 10 can be positioned in vertical alignment with the pricing channel 101 of the shelving area 100. An illustration as to how products 200 can be displayed on the shelf wedge 10 is shown in FIG. 8.

Figure 9:
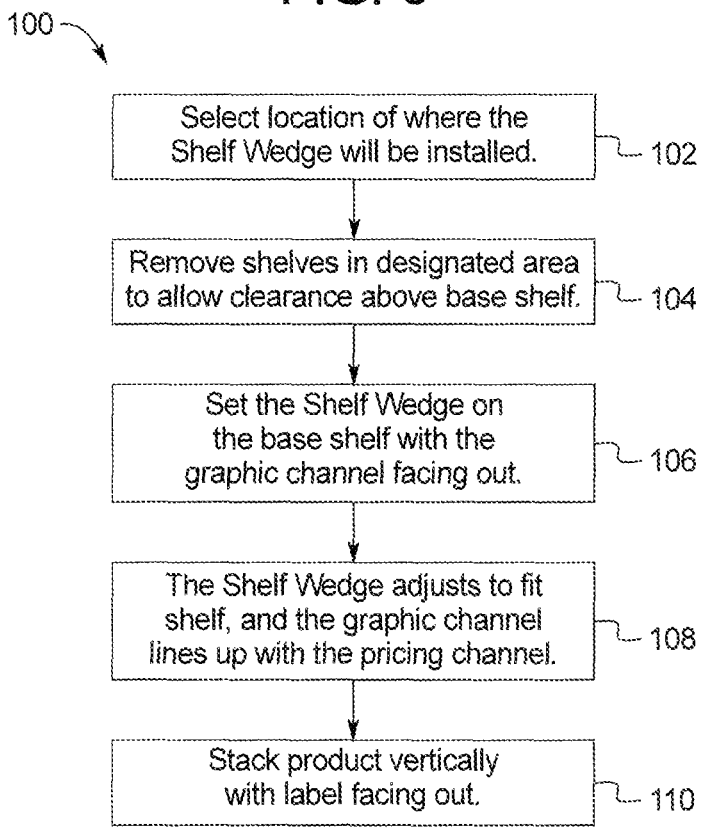
FIG. 9 is a flowchart of an embodiment of a method provided by the present disclosure.

FIG. 9 is a flowchart of an embodiment of a method 100 provided by the present disclosure. In Step 102, the location where the shelf wedge 10 will be installed is selected. In Step 104, one or more shelves can optionally be removed from the shelving area 100 to accommodate the shelf wedge 10, for example to provide clearance for the shelf wedge 10 (e.g., thirty inches of clearance above the shelf on which the shelf wedge is positioned). In Step 106, the shelf wedge 10 can be positioned on a shelf of the shelving area 100. In Step 108, the base section 20 of the shelf wedge 10 can be moved relative to the back section 30 to decrease or increase the length of the shelf wedge 10, and/or the front face 23 of the shelf wedge 10 can be positioned in vertical alignment with the pricing channel 101 of the shelving area 100. In Step 110, products 200 can be displayed on the shelf wedge 10 by positioning the products 20 on the top surface 25 of the base section 20.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

I claim:

1. An apparatus for displaying products, the apparatus comprising:

a base section comprising a first end and a second end that are opposite ends of the base section from each other, the first end defining a front face and having a height greater than the second end; and a back section comprising a body movably connected to the second end of the base section, the back section further comprises a first projection that extends from the body of the back section, the second end of the base section comprises a first channel, at least a portion of the first projection has a size and a shape complementary to at least a portion of the first channel, the base section is configured to slide on the first projection toward and away from the body of the back section, the base section comprises an inner wall that forms a side of the first channel, the back section comprises a second projection, and the inner wall of the base section inserts between the first and second projections.

2. The apparatus of claim 1, wherein the base section comprises first and second side walls, and the first side wall forms a side of the first channel opposite to the side of the first channel formed by the inner wall.

3. The apparatus of claim 2, wherein the base section comprises a top surface that extends from the first end to the second end, the top surface is flat, and the inner wall and the first and second side walls extend downward from the top surface.

4. The apparatus of claim 3, wherein the base section comprises a bottom surface from which the inner wall and the first and second side walls extend upward to the top surface, and the bottom surface is flat.

5. The apparatus of claim 4, wherein the front face and the bottom surface form an angle that is less than ninety degrees.

6. The apparatus of claim 1, wherein the first end of the base section comprises a clip arrangement configured to hold printed material on the front face.

7. A system for displaying merchandise, the system comprising:

a base section comprising a first end and a second end that are opposite ends of the base section from each other, the first end defining a front face and having a height greater than the second end, the base section comprising a top surface that extends from the first end to the second end;

a back section comprising a body movably connected to the second end of the base section, the back section further comprises a first projection that extends from the body of the back section, the second end of the base section comprises a first channel, at least a portion of the first projection has a size and a shape complementary to at least a portion of the first channel, the base section is configured to slide on the first projection toward and away from the body of the back section, the base section comprises an inner wall that forms a side of the first channel, the back section comprises a second projection, and the inner wall of the base section inserts between the first and second projections; and a product removably positioned on the top surface of the base section.

8. The system of claim 7, wherein the top surface of the base section comprises a cavity having a size and a shape that are complementary to at least a portion of the product.

9. The system of claim 7, wherein the product is one of a plurality of products that are positioned on the top surface.

10. The system of claim 7, wherein the base section and the back section form an apparatus having a length that is the distance from the front face of the base section to a rear face of the back section, and the apparatus is configured such that sliding the base section toward and away from the body of the base section decreases and increases the length of the apparatus, respectively.

11. A method of displaying a product on a shelf, the method comprising:

positioning an apparatus on the shelf, the apparatus having a length and comprising a base section comprising a first end and a second end that are opposite ends of the base section from each other, the first end defining a front face and having a height greater than the second end, the apparatus further comprising a back section comprising a body movably connected to the second end of the base section, the back section further comprises a first projection that extends from the body of the back section, the second end of the base section comprises a first channel, at least a portion of the first projection has a size and a shape complementary to at least a portion of the first channel, the base section comprises an inner wall that forms a side of the first channel, the back section comprises a second projection, and the inner wall of the base section inserts between the first and second projections;

adjusting the length of the apparatus by moving the base section toward or away from the body of the back section, the moving of the base section toward or away from the body of the back section comprising sliding the base section on the first projection; and positioning the product on a top surface of the base section.

12. The method of claim 11, wherein the adjusting the length of the apparatus comprises positioning the front face of the base section in vertical alignment with a front edge of the shelf.

13. The method of claim 11, wherein the adjusting the length of the apparatus comprises positioning a rear face of the back section in vertical alignment with a back edge of the shelf.

14. The method of claim 11, wherein the length of the apparatus is the distance from the front face of the base section to a rear face of the back section.

15. The method of claim 11, comprising attaching printed material to the front face using a clip arrangement connected to the first end of the base section.

16. The method of claim 11, comprising removing an additional shelf from a position above the shelf before positioning the apparatus on the shelf.

* * * * *